US005831546A

United States Patent [19]

Costa et al.

[11] Patent Number: 5,831,546

[45] Date of Patent: Nov. 3, 1998

[54] AUTOMATIC ADDRESSING IN LIFE SAFETY SYSTEM

[75] Inventors: Hilario S. Costa, Sarasota; Donald J. Munn, Bradenton, both of Fla.

[73] Assignee: General Signal Corporation, Stamford, Conn.

[21] Appl. No.: 644,816

[22] Filed: May 10, 1996

[51] Int. Cl.[6] ..... G08B 25/00

[52] U.S. Cl. ..... 340/825.52; 340/825.43; 340/518; 340/825.78; 307/41; 364/264

[58] Field of Search ..... 340/825.52, 825.43, 340/825.77, 825.13, 825.49, 825.36, 511, 518, 825.78; 307/38, 41, 40; 364/926.91, 940.6, 264; 395/311

[56] References Cited

U.S. PATENT DOCUMENTS

| | | | |
|---|---|---|---|
| 4,568,919 | 2/1986 | Muggli et al. | 340/518 |
| 4,603,318 | 7/1986 | Philp | 340/518 X |
| 4,752,698 | 6/1988 | Furuyama et al. | 307/116 |
| 4,850,018 | 7/1989 | Vogt et al. | 380/23 |
| 4,954,809 | 9/1990 | Right et al. | 340/516 |
| 4,962,368 | 10/1990 | Dobrzanski et al. | 340/514 |
| 5,226,123 | 7/1993 | Vockenhuber | 395/311 |
| 5,450,072 | 9/1995 | Vockenhuber | 340/825.52 |
| 5,646,609 | 7/1997 | O'Brien | 340/825.52 X |

FOREIGN PATENT DOCUMENTS

| | | |
|---|---|---|
| 0090399A1 | 10/1983 | European Pat. Off. . |
| 2168517 | 6/1986 | United Kingdom . |
| 9604629A1 | 2/1996 | WIPO . |

*Primary Examiner*—Brian Zimmerman
*Assistant Examiner*—William H. Wilson, Jr.
*Attorney, Agent, or Firm*—Ohlandt, Greeley, Ruggiero & Perle

[57] ABSTRACT

An automatic addressing scheme for a life safety system having a local rail, and a plurality of modules interconnected by the local rail, a first of the modules being a central processing unit, and the remainder being I/O modules having a variety of functions, as well as a common line forming part of the local rail; an arrangement is provided for detecting the location of each of the I/O modules and assigning addresses thereto without human intervention, the arrangement including a resistor and transistor, capable of being conductive to ground, associated with each I/O module. A constant current source is located at the central processing unit, connected by the common line to the resistors in series circuit, and with a common address input means connected from the central processing unit to said common line and thereby to the I/O modules. Further there is an arrangement for providing a cycle of voltage measurements in which successive variable voltage drops are measured from the CPU to the particular transistor actually conducting to ground.

8 Claims, 4 Drawing Sheets

AUTOMATIC ADDRESSING IN LIFE SAFETY SYSTEM

BACKGROUND OF THE INVENTION

This invention relates to life safety systems and more particularly to a fire alarm system or the like in which provision is made for automatic assignment of addresses to individual modules forming part of the system.

The above noted modules are located at the central station or central panel location at which reports come in from a variety of zones and stations with respect to alarm and trouble conditions and the like. The present invention constitutes one feature of a life unique safety system (e.g., fire alarm system). Other inventive features of that system can be appreciated by reference to the following co-pending applications:

| | |
|---|---|
| 08/644,479 | Life Safety Having A Panel Network With Message Priority-Allowed |
| 08/644,834 | Audio Communication System For A LifeSafety Network-Pending |
| 08/644,835 | PhoneControl Center For A LifeSafety Network Allowed |
| 08/644,478 | Configuration Programming For A Life Safety Network Pending |
| 08/644,815 | Core Modules For A Life Safety System and Struture For Supporting Such Modules In a Panel Housing now USP 5,721,672 |

all of which above applications have been assigned to the assignee of the present invention.

The details of the construction and operation of the features described in the above noted related applications are incorporated herein by reference.

The present invention is in the field of fire alarm and detection systems. Examples of prior systems of this general type may be appreciated by reference to the following U.S. patents:

| U.S. Pat. | Inventors | Issued |
|---|---|---|
| 4,568,919 | J. Muggli, et al | February 4, 1986; |
| 4,752,698 | A. Furuyama, et al | June 21, 1988; |
| 4,850,018 | W. R. Vogt | July 18, 1989; |
| 4,954,809 | R. W. Right, et al | September 4, 1990; |
| 4,962,368 | J. J. Dobrzanski, et al | October 9, 1990. |

Most of the above cited U.S. patents describe systems that are approximately six to ten years old, and in most of these systems the loop controller initiates the determination of the states of the units at the various zones or stations in the system by the use of a repetitive polling scheme for polling the detector units or stations from the loop controller, whereby addresses are sent successively on the loop or lines to determine which, if any, units are in an alarm state. Provision is also made in most of these systems to detect trouble conditions in the system.

Other fire detector and alarm systems have been developed in the recent past, that is, in the past five years or so, that provide a variety of features, including the feature of an intelligent transponder combined with an integral processor, such that communication to the loop controller of the fact that a particular transponder is in alarm is initiated by the transponder. This is sometimes called polling by exception. This results in lower communications speed while substantially improving control panel response time. Such a feature makes the system less sensitive to line noise and to loop wiring properties; hence, twisted or shielded wire is not required.

The above described intelligent transponder feature may be appreciated by reference to several U.S. patents. Many of these prior art patents describe central receivers having improved intelligence for communication with a plurality of satellite devices. For example, U.S. Pat. No. 4,901,316 to A. Igarashi, et al, entitled DISASTER PREVENTION MONITORING AND CONTROL FACILITY provides a receiver for polling a plurality of terminal units. The receiver reads terminal information from the terminals, analyzes the terminal information, and displays the results of its analysis. Also, the receiver monitors the accuracy of transmissions between the receiver and the terminal units. Thus, the receiver can accurately check for an erroneous transmission of a signal that may occur between the receiver and one of the terminal units.

Whatever the utility and advantages of the above patented systems, they lack the benefits of the present invention to be described herein.

It will be apparent that there are a number of major deficiencies in prior art life safety systems. For example, prior systems have used switches to set addresses and the particular positions of modules, which are located on panels at the central station, were pre-determined. Other prior art systems use programmed addresses or serial numbers; thus these pre-programmed addresses or serial numbers were entered into the modules typically at the factory, or were entered by the user before the system was put into operation.

A fundamental object of the present invention is to enable, without human intervention, the automatic position or location, as well as the sensing and addressing of printed circuit boards—which form the modules of the panel system—by means of an integral bus structure, thereby avoiding the need for unique address switches or pre-programmed addresses.

An ancillary object is to avoid the cost of switches or the overhead of providing unique serial numbers or addresses.

SUMMARY OF THE INVENTION

In accordance with the present invention there are no switches for enabling the setting of addresses in a conventional way; and, in fact, there are no set addresses at all in the conventional sense. However, the system can detect the location of each printed circuit board or boards forming a module and can assign addresses electronically without human intervention.

The fundamental feature which fulfills the above stated objects is characterized as follows:

An automatic addressing scheme for a life safety system comprising: a local rail, including a plurality of individual lines; a plurality of modules inter-connected respectively by the individual lines of said local rail, a first of the modules being a central processing unit, and the remainder being I/O modules having a variety of functions; a common line also forming part of said local rail; further for detecting the location of each of the I/O modules and assigning addresses thereto without human intervention, said means including a resistor and transistor, capable of being conductive to ground, associated with each I/O module; and a constant current source at said central processing unit connected by said common line to the resistors in series circuit; a common address input means connected from said central processing unit to said common line and thereby to said I/O modules; also for providing a cycle of voltage measurements in which successively cumulative voltage drops, corresponding to different numbers of resistors in said series circuit in which current is flowing, are measured at respective successive times; said means being connected through the resistors from the CPU to the particular transistor actually conducting at those times to ground, whereby said voltage measurements define the respective address values for the modules.

A further subordinate feature of the present invention resides in an arrangement whereby initially all of the transistors in series on the common line are turned ON by signals applied to their gates from the CPU; thereafter the transistor in the module which is closest to the CPU is turned OFF; the transistor which is next closest of the remaining transistors to the CPU is then turned OFF, and so on; measurements are sequentially taken of the voltage drops across all series resistors included in the common line to ground by way of the particular transistor actually conducting current to ground at a given time. Consequently, a unique voltage drop value identifies each of the particular module locations, thereby constituting a unique address for each module.

Other and further objects, advantages and features of the present invention will be understood by reference to the following specification in conjunction with the annexed drawings, wherein like parts have been given like numbers.

DESCRIPTION OF PREFERRED EMBODIMENT

Figure 1:
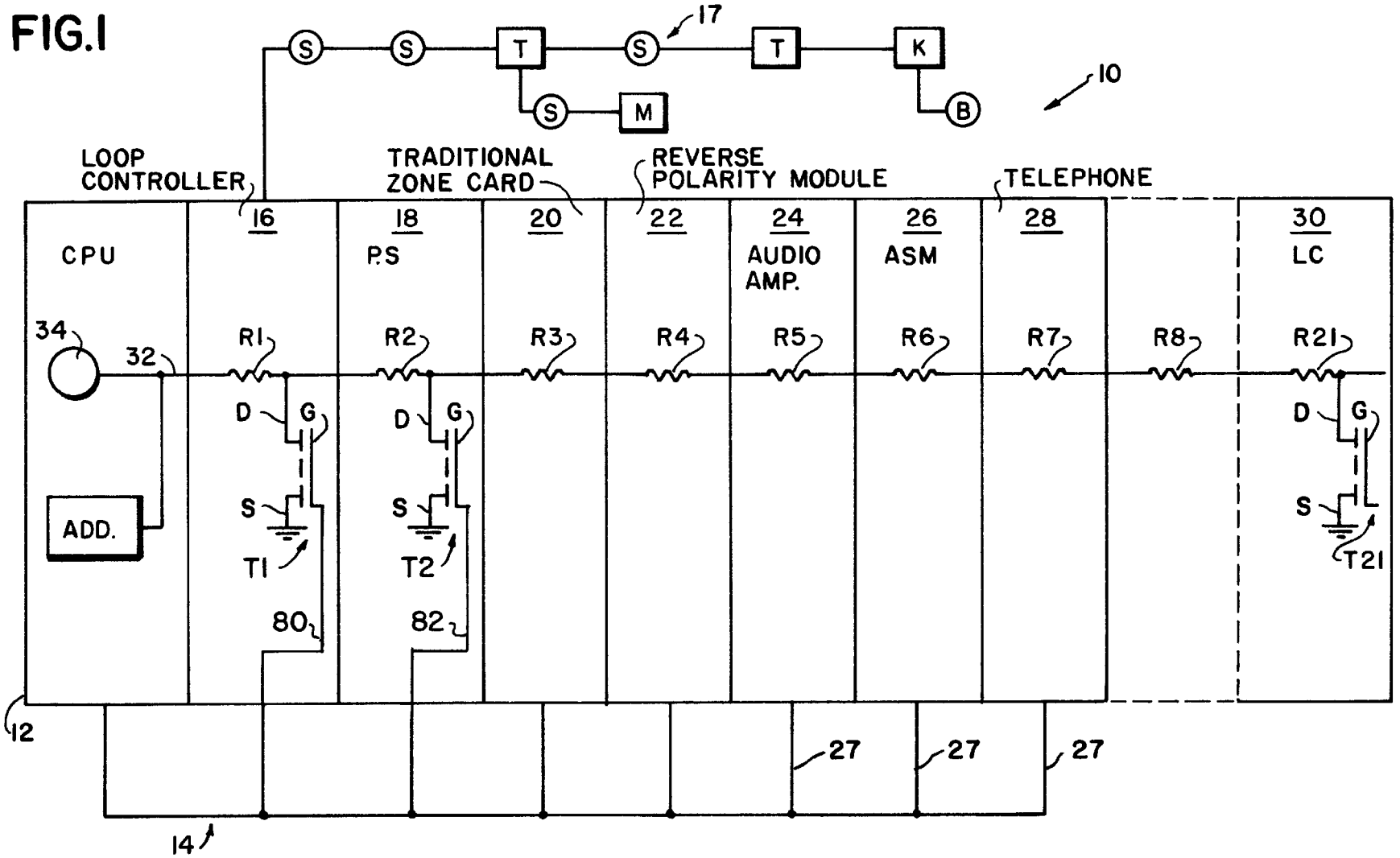
FIG. 1 is a block diagram of one panel of the multiple panel sub-system in accordance with the present invention and showing a representative group of twenty-one modules for that one panel with the basic inter-connections and communication links between the individual modules.

Referring now to the figures of the drawing and for the moment to FIG. 1 thereof, there will be seen a diagram of one panel 10 of a panel sub-system, said panel 10 including a representative group of so-called modules, which are individual units containing circuit boards, and provision for inter-connections among the various modules. The central processing unit or master module 12 is shown interconnected by means of the bus or local rail 14 to the other modules, the first module being a loop controller 16 whose essential functions will be understood from the prior art; namely, that it connects a group of smoke detectors, transponders and like devices in a line 17. As will be understood from the prior art, the remote stations having the smoke detectors S or transponders T and the like can be connected in either of class A or class B mode,—the class A mode involving a typical complete loop which returns to the controller; but as specifically shown by the line 17, class B mode of operation can also be provided, in which the devices are connected in parallel across a pair of conductors and, if desired, the line can be terminated in a terminating resistor (not shown).

Seen to the right of the loop controller 16 is a power supply (P.S.) 18 for purposes well understood, followed on the right by a traditional zone card 20, a reverse polarity module 22, audio amplifier 24, and an audio service module (ASM) 26. The latter two modules are connected to the CPU by a special audio data line 27. A telephone module 28 is shown next to module 26, and additional modules may be included as indicated by the dotted lines; the last module on the far right is another loop controller 30.

The local rail designated by the numeral 14 includes the variety of links or connections between modules, including the Audio Data line 27, as well as power and communication links. For purposes of efficient power and transmission and communication, the rail is actually sometimes divided into two separate rails, a top rail having plus 5 volts and a bottom rail having 24 volts for purposes to be explained. Also, provided as part of 14 is what is called an RS-485 communications link for purposes which will also be explained.

A further line is the common line 32 which operates to realize the essential objectives of the inventive feature of the present invention; thus this common line enables connection of a constant current source 34 at the CPU so that such source may supply current in a serial manner to all of the modules 16 through 30 through individual resistors R1–R21, which are of equal value (approximately 47 ohms) and are associated with the respective modules. However, because of the sequential turn OFF of the transistors T1–T21, selective shunting of current through the transistors takes place such that different, uniquely, identifying voltage drops may be measured as a means for assigning addresses to variously located modules. This operation of the automatic address feature will be fully explained hereinafter.

Figure 2:
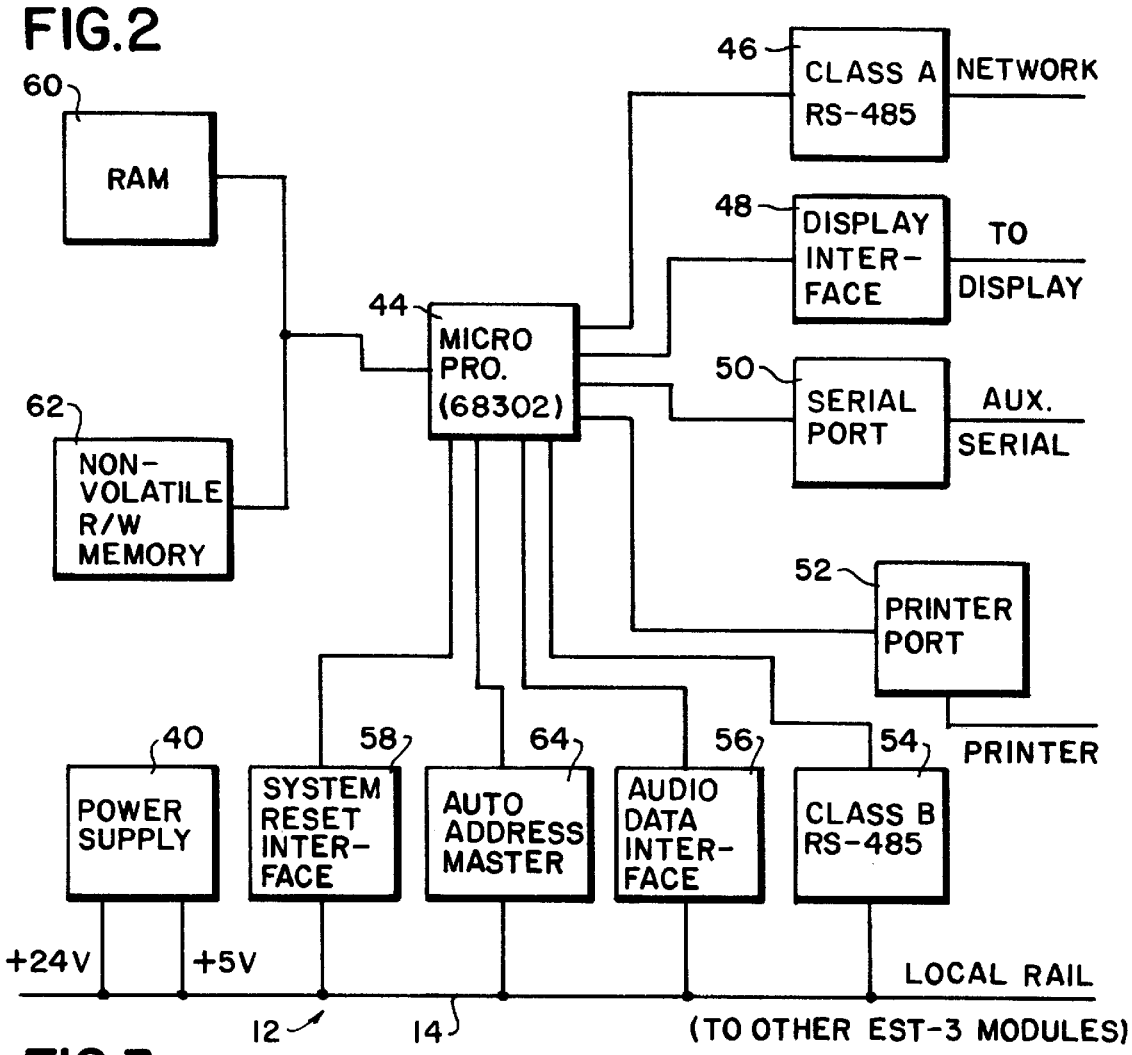
FIG. 2 is a block diagram of the central processing unit or module forming part of the fire alarm system of the present invention with indicated connections to the rest of the system.

Referring now to FIG. 2, it is considered helpful to the reader to explain in some respects the layout of the CPU and its several functions. The CPU 12, of course, is the master unit or module of the panel sub-system and is instrumental in co-coordinating all the operations of the modules. As seen in FIG. 1, the CPU is designed to be installed in the left most position (logical address zero) along the local rail 14. In this position it functions as the local bus master and supervises all bus traffic. It provides 5 volts to the local rail as well as 24 volts to the local rail as required by the other modules.

A microprocessor 44 (68302) is at the center of the CPU layout. The microprocessor 44 directs class A network operation by reason of its connection to interface 46, which, in turn, is connected to the CPU network, i.e., to the other CPUs which form part of a panel sub-system. A display interface 48 and a serial port 50 are also provided. It will be understood that printer operations are controlled via printer port 52 and that class B operations are effected by connection of interface 54. For audio communication, audio date interface 56 is connected to microprocessor 44; a system reset interface 58 is also seen connected to the microprocessor 44 for reset purposes. For the purpose of providing suitable memory a Ram 60 and a non-volatile read/write memory 62 are seen connected to the microprocessor 44.

For purposes of the present invention the key functional block is the auto address master 64 which handles the communication between the microprocessor and the various other local rail I/O modules seen in FIG. 1; thus controlling the entire operation through software embedded in CPU 12.

Figure 3:
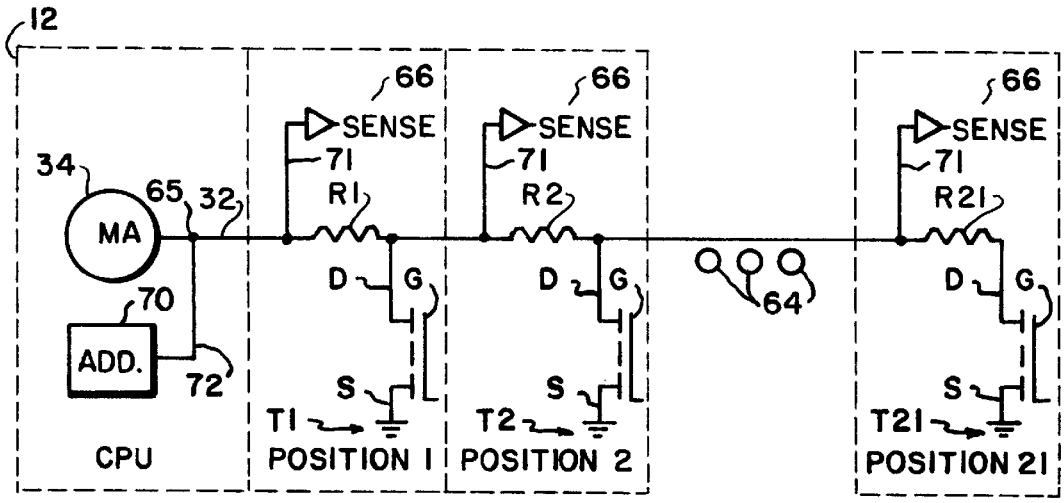
FIG. 3 is a simplified functional diagram showing the operation of the automatic addressing feature of the present invention.

For the sake of clarity FIG. 3 shows in enlarged, simplified form several of the modules from FIG. 1, that is, the CPU 12 and three positions of I/O modules, one labeled position 1, another position 2 and a third, at the far right, position 21 (21 positions being included in the panel subsystem). The constant current source 34 is again seen in FIG. 3 connected to common line 32, shown separated from rail 14 to highlight its function, but actually forming part of rail 14. A common address input means 70 at the CPU 12 is seen connected at node 65 to the common line 32. Individual sense inputs 66 at the CPU 12 are connected by way of the respective sense resistors R1–R21 in respective module locations or positions 1, 2 & 21 to the respective transistors T1, T2 and T21 in said positions. Blank positions are represented by the gap (three circles 68) between position 2 and position 21, although the continuity of line between position 2 and position 21 is maintained through resistors at the blank positions.

The CPU 12 implements the auto address master function by reason of the auto address master interface 64 (FIG. 2) which transmits a command to all of the modules in the several positions in FIG. 3 which causes them to enter an "auto address mode". Typically, the CPU 12 provides a 10 milliamp constant current source 34 as part of the auto address master function to allow the auto address/location circuit seen in FIG. 3 to determine the absolute module locations. The CPU then assigns addresses to the locations or positions; this is accomplished by the CPU functioning to measure the voltage on the address (ADD.) sense line 72. Because the CPU 12 is engaged at this point with voltage measurement, the input to the CPU from line 72 is a high impedance input. The voltage drop value measured is a function of the number of sense resistors (R1, R2, etc.) through which current flows to ground through a given conducting transistor.

When the CPU 12 issues the afore-noted command to all the modules telling them to turn their transistors (Mosfets) ON, the modules respond by placing the gates G of the Mosfets at a ONE voltage. Therefore, all Mosfets appear as short circuits from drain to source effectively grounding the resistors.

As a preliminary procedure, which avoids ambiguities and inaccuracies in subsequent address measurements, the modules thereupon first determine, in turn, if they are the closest module to the CPU. The module which is closest will yield a voltage measurement of 0.47 v DC (10 mA×47 ohms) at its individual sense line 71, which is transmitted to respective CPU sense inputs 66. All other modules will yield a measurement of 0 volts at their sense lines. This is because no current from source 34 is flowing through the transistors of those modules not closest to the CPU; instead, all of the current is flowing to ground through transistor T1 of the position 1 module. The same situation exists in sequence for each of the modules in succession to the right of position 1, i.e., the next closest to the first, or T2; then the next closest to T2, or T21. This is because programming embedded in CPU memory 60 and 62 commands the turn OFF, in turn, of the respective Mosfets once their voltage values have already been measured.

After the preliminary procedure has been performed for each position, i.e., checking to determine if the next module position is closest to the CPU, the CPU then acquires by way of the common ADD. input 70 at the auto-address master 64, the voltage measurement defining the address value for the position. For the position 1 case just described, it stores this voltage value in digital form (by A/D conversion) in RAM 60. It should be noted, parenthetically, that this address value is used, for example, during a fast response alarm procedure to determine which module has its Mosfet turned ON. It will be apparent that as modules to the right of position 1 have their voltage values read or measured, by way of the ADD. input 70, (and are assigned addresses), such measured values will rise incrementally; and likewise the assigned addresses will increase proportionately or cumulatively. For example, position 2 will next be identified at the common address means or master 64 by a voltage value twice that of position 1; thereafter, position 3 will be identified by a voltage value three times that of position 1; and so on. Hence, unique addresses will be assigned to each position based on the respectively different voltage values.

It will be understood that the reason for the rise in voltage values as the process continues to the right is that the CPU gives another command to which the already processed module of position 1, for example, responds by placing its transistor gate G at zero voltage, thereby turning its Mosfet OFF. This is accomplished by means of the programming embedded in CPU memory, which is organized to produce the required command at the appropriate point in the process when a given module—such as the module at position 1—has had its voltage value measured. The same operation is carried out with respect to the transistor of each module in the other positions.

Figure 4:
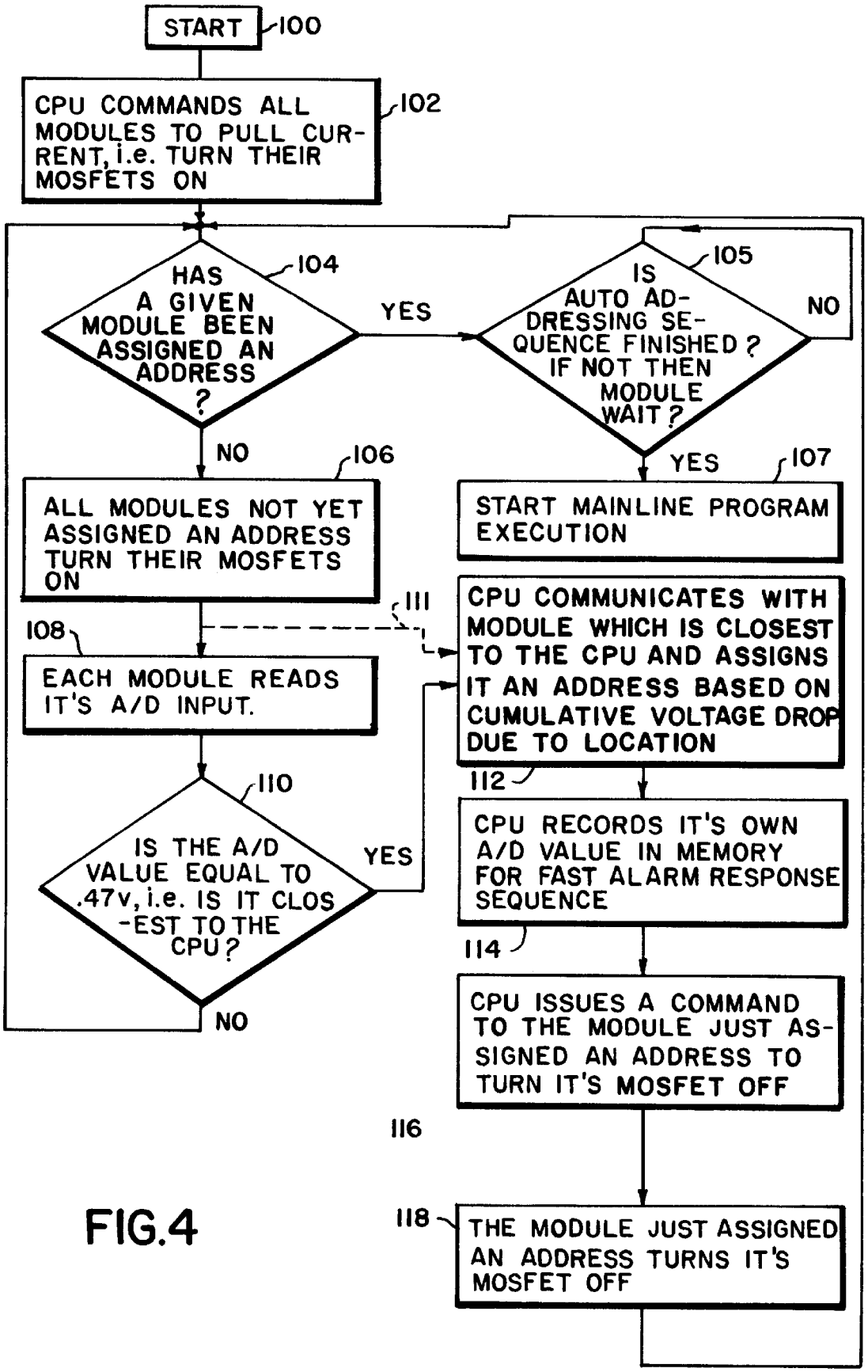
FIG. 4 is a flow or process chart relating to the automatic addressing feature of the present invention.
Figure 5:
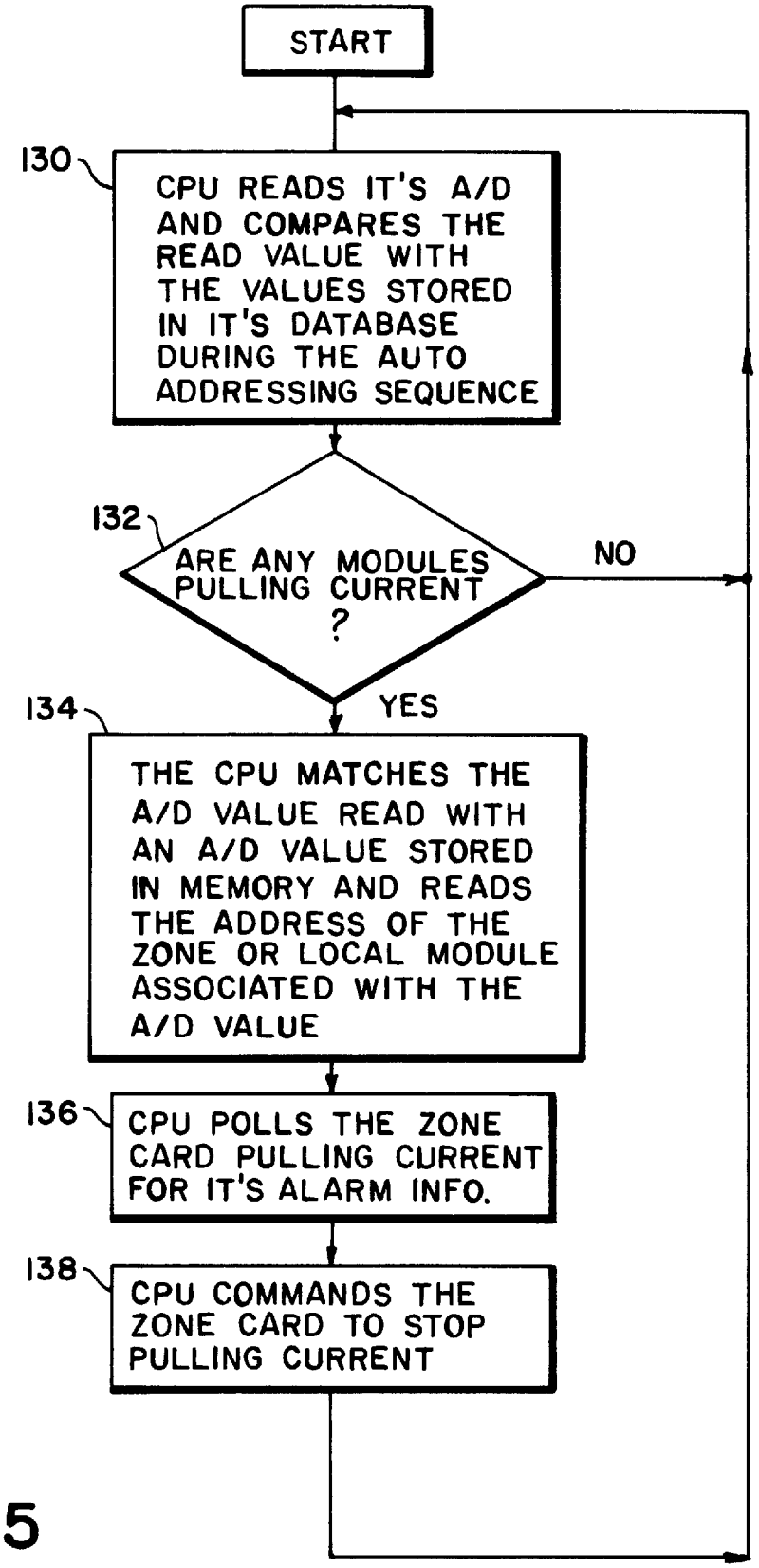
FIG. 5 is a flow chart relating to the fast alarm response sequence enabled or resulting from the automatic addressing feature.

Referring now to FIGS. 4 and 5 of the drawing, illustrated therein are the system process steps or operations in accordance with the present invention; that is to say the various actions dictated by the controlling software. It will be understood by those skilled in the art that the present invention comprises both hardware as depicted in FIGS. 1 through 3, and a software component to be explained.

The system already described operates under the direction of software (that is, a program or set of instructions) for producing particular states within the computer (controlling CPUs), which, in turn, cause or effectuate the desired output operations of the system being controlled. The steps depicted by the various blocks in the flow or process diagram of FIG. 4 are the sequential steps or operations involved in the auto-addressing feature of the invention. Moreover, these blocks in FIG. 4 also represent—as will be apparent to those skilled in the art—the means, including program means, for realizing the indicated operations. FIG. 5 depicts the advantageous result achieved, that is, the capability of a fast alarm response sequence, represented by the blocks shown therein, enabled by this auto-addressing feature.

Proceeding from the block 100 which indicates the start of the auto-addressing sequence, the first step or operation is indicated by block 102 which involves the CPU commanding all modules to pull current, that is, to turn on the individual Mosfets (already discussed) contained in each of the modules 16–30 in FIG. 1. The next step involves a decisional logic block 104 which has a NO output and a YES output, the latter extending to blocks 105 and 107. The remaining steps from the NO output, i.e., steps 106, 108, 110, 112, 114, 116 and 118, depict the various steps or operations already described in the specification with respect to the circuitry illustrated in FIGS. 1 through 3. For the sake of brevity, these steps will not be re-described, since it is believed that these will be self-evident to one skilled in the art. Such remaining steps follow logically from the NO output from block 104 and the YES output from block 110.

However, it should be noted that if it is found in some case that an unambiguous or certain measurement can be obtained without the need to perform steps 108 and 110, then, as shown by the dotted line 111, the process could jump from block 106 directly to block 112 and continue from there. Thus, the procedure of checking first to insure that a given module is actually closest to the CPU by measuring from each individual sense input 66 can be obviated in those cases. The only measurement taken by this alternate procedure—involving the dotted line 111—is a cumulative measurement by the common address means 70, thereby to obtain the voltage drop values in succession from each of the cumulative resistance totals due to respectively different transistors conducting to ground along the length of the common line 32.

The simplification in polling requirements that is achieved can be understood from FIG. 5. The steps or operations seen in FIG. 5 flow from the fact that the auto-addressing function has already been carried out. Accordingly, the sequence in FIG. 5 begins as indicated by the start block and proceeds to the other steps shown by the blocks 132–138.

Let us now take, for example, the situation where an alarm condition exists at a given zone or station. Such condition is monitored by a particular zone module, for example, module 16 of FIG. 1. The result of preliminary steps 130 and 132 is the determination that such module is drawing or pulling current, whereupon step 134 involves the controlling CPU 12 of FIG. 1 matching the values specified, and then reading the address of the affected module 16. By means of subsequent step 136 the zone module 16 is polled by CPU 12 since there are usually 4 zones handled by each zone module such that it is necessary to pin-point what particular zone is in alarm. Thereafter, as seen by step 138, the CPU 12 commands the zone module 16 to stop pulling current.

The invention having been thus described with particular reference to the preferred forms thereof, it will be obvious that various changes and modifications may be made therein without departing from the spirit and scope of the invention as defined in the appended claims.

We claim:

1. An automatic addressing scheme for a life safety system comprising:

a local rail, including a plurality of individual lines;

a plurality of modules inter-connected respectively by the individual lines of said local rail, a first of the modules being a central processing unit, and the remainder being I/O modules having a variety of functions;

a common line also forming part of said local rail;

means for detecting the location of each of the I/O modules and assigning addresses thereto without human intervention, said means including a resistor and transistor, capable of being conductive to ground, associated with each I/O module; and a constant current source at said central processing unit connected by said common line to the resistors in series circuit;

a common address input means connected from said central processing unit to said common line and thereby to said I/O modules;

means for providing a cycle of voltage measurements in which successively cumulative voltage drops, corresponding to different numbers of resistors in said series circuit in which current is flowing, are measured at respective successive times; said means being connected through the resistors from the CPU to the particular transistor actually conducting at those times to ground, whereby said voltage measurements define the respective address values for the modules.

2. A scheme as defined in claim 1, further comprising individual input means at the CPU for sensing that a module is the next closest to the CPU as the cycle of voltage measurements proceeds.

3. A scheme as defined in claim 1, further comprising means for having the CPU read at a given time an address input, for storing its value, and for assigning a unique address to each I/O module corresponding to a particular measured voltage drop based on that module being the closest to the CPU, the particular transistor of each module then being conductive at a particular time in said cycle of voltage measurements.

4. A scheme as defined in claim 1, further comprising an individual sense line connected to each of said I/O modules and to said CPU for assuring that each successive voltage measurement in said cycle relates to the next transistor closest to the CPU.

5. A scheme as defined in claim 4, further comprising means for initially measuring at said sense line the voltage across the resistor of the module closest to the CPU, all other modules reading zero volt DC at their sense inputs.

6. A scheme as defined in claim 4, further comprising means at the CPU for assigning a unique address to the module closest to the CPU at a given time in the cycle of measurement; and means for thereafter commanding said module that has just been assigned its address to turn its transistor off whereby the module next closest to the CPU of the remaining modules then conducts current.

7. A scheme as defined in claim 1, further comprising means for initially biasing the control electrodes of all the transistors at the respective module locations such that each transistor has a low impedance to ground, but whereas current is conducted only through that transistor which is closest to the CPU at a given time in the cycle so as to enable sensing of the voltage drop across the respective resistor associated with the transistor actually conducting at the given module location.

8. A scheme as defined in claim 1, in which the transistors are metal oxide semi-conductor field effect transistors, each having a gate, source and drain; means for providing a bias voltage to the gates of said transistors such that they all effectively provide a low impedance from their source to their drain.

* * * * *